US008696393B2

(12) United States Patent
Power

(10) Patent No.: US 8,696,393 B2
(45) Date of Patent: Apr. 15, 2014

(54) WATER JET BASED UNDERWATER THRUSTER

(75) Inventor: Randal Joseph Harold Power, Mt. Pearl (CA)

(73) Assignee: College of the North Atlantic, St. John's, Newfoundland & Labrador (CA)

( * ) Notice: Subject to any disclaimer, the term of this patent is extended or adjusted under 35 U.S.C. 154(b) by 219 days.

(21) Appl. No.: 13/200,716

(22) Filed: Sep. 29, 2011

(65) Prior Publication Data

US 2012/0083174 A1 Apr. 5, 2012

(30) Foreign Application Priority Data

Sep. 30, 2010 (CA) ..... 2723538

(51) Int. Cl.
*B63H 11/107* (2006.01)
*B63H 25/46* (2006.01)
*F16K 31/46* (2006.01)

(52) U.S. Cl.
USPC ..... 440/40; 114/151; 251/30.05

(58) Field of Classification Search
USPC ..... 440/38, 40; 251/30.01, 30.02, 30.03, 251/30.04, 30.05; 114/151
See application file for complete search history.

(56) References Cited

U.S. PATENT DOCUMENTS 2,964,286 A * 12/1960 Hoskins ..... 251/30.04
3,132,477 A 5/1964 Egger
3,176,648 A 4/1965 Cavero
3,492,965 A 2/1970 Wayfield
3,675,611 A * 7/1972 Glass ..... 440/40
4,265,192 A 5/1981 Dunn
5,014,912 A 5/1991 Brooks
5,129,846 A 7/1992 Dimijian
5,267,883 A * 12/1993 Gudmundsen ..... 440/38
6,453,835 B2 9/2002 Fadeley et al.
6,926,567 B1 8/2005 Dai et al.
7,124,698 B1 10/2006 Shen et al.
7,290,496 B2 11/2007 Asfar et al.
7,891,603 B2 2/2011 Voorhees
8,172,197 B2 * 5/2012 Gu et al. ..... 251/30.03
8,500,087 B2 * 8/2013 Cheng ..... 251/129.15

FOREIGN PATENT DOCUMENTS

WO WO 9200221 A1 * 1/1992

* cited by examiner

*Primary Examiner* — Lars A Olson
*Assistant Examiner* — Andrew Polay
(74) *Attorney, Agent, or Firm* — Mario Theriault

(57) ABSTRACT

The thruster pod that is made of a pump plate; a valve plate affixed to the pump plate, and a diaphragm mounted between the pump plate and the valve plate. The pump plate has juxtaposed pressure cavity and outlet cavity, and a partition separating the pressure cavity from the outlet cavity. The pressure cavity communicates with a source of water under pressure and the outlet cavity communicates with an outlet port. The valve plate has a control chamber facing the juxtaposed pressure and outlet cavities. The diaphragm is mounted between the juxtaposed pressure and outlet cavities and the control chamber for movement between a first position and a second position upon a change in pressure in the control chamber. A control valve is mounted in the valve plate for selectively changing a pressure in the control chamber and operating a diaphragm valve.

3 Claims, 7 Drawing Sheets

WATER JET BASED UNDERWATER THRUSTER

FIELD OF THE INVENTION

This invention pertains to water jet propulsion systems, and more particularly it pertains to water jet propulsion system having selectively operable thrusters and steering nozzles.

BACKGROUND OF THE INVENTION

In order to characterize the present invention over the prior art, reference is made to existing valves on water jet propulsion systems that are used for steering and positioning a water craft:

U.S. Pat. No. 3,132,477 issued to J. C. Egger on May 12, 1964;

U.S. Pat. No. 3,176,648 issued to M. Cavero on Apr. 6, 1965;

U.S. Pat. No. 3,492,965 issued to D. J. Wayfield on Feb. 3, 1970;

U.S. Pat. No. 3,675,611 issued to J. P. Glass on Jul. 11, 1972;

U.S. Pat. No. 4,265,192 issued to G. L, Dunn on May 5, 1981;

U.S. Pat. No. 5,014,912 issued to D. A. Brooks on May 14, 1991;

U.S. Pat. No. 5,129,846 issued to B. A. Dimijian on Jul. 14, 1992.

The valve systems described in the above-mentioned documents have multiple outlet ports that are controlled by mechanical actuators. These systems also comprise a pump and a valve cluster that are located inside the boat. The nozzles extend at a shallow depth under the boat where water pressure at the nozzles is negligible. These systems are designed for above-water operation, basically.

U.S. Pat. No. 7,124,698 issued to Y. T. Shen et al. on Oct. 24, 2006; describes a maneuvering system for a submarine. A pump draws water from one end of a tube and forces this water to an outlet at the other end of the tube. The outlet is oriented in such a way to steer the water craft. The system is controlled by gate valves operated by mechanical actuators. The pump and the valve actuators need to be sealed from deep water pressure to prevent damage.

Although the systems of the prior art deserve undeniable merits, it is believed that there is a need in the marine industry for an underwater thruster and guidance system that is easy to manufacture and that is more appropriate for use in remotely operated vehicles in deep sea applications.

SUMMARY OF THE INVENTION

In the present invention, however, there is provided a thruster pod that is insensitive to deep sea pressures.

In a first aspect of the present invention, there is provided a thruster pod that is made of a pump plate; a valve plate affixed to the pump plate, and a diaphragm mounted between the pump plate and the valve plate. The pump plate has juxtaposed pressure cavity and outlet cavity, and a partition separating the pressure cavity from the outlet cavity. The pressure cavity communicates with a source of water under pressure and the outlet cavity communicates with an outlet port for projecting a jet of water under pressure outside the pump plate. The valve plate has a control chamber facing the juxtaposed pressure and outlet cavities.

The diaphragm is mounted between the juxtaposed pressure and outlet cavities and the control chamber for movement between a first position and a second position upon a change in pressure in the control chamber. The first position blocking the juxtaposed pressure and outlet cavities, and the second position opening the juxtaposed pressure and outlet cavities for allowing a flow of water under pressure under the partition from the pressure cavity to the outlet cavity and to the outlet port.

A control valve is mounted in the valve plate for changing a pressure in the control chamber. The control valve has a connection to the pressure cavity; to the control chamber and to ambient water pressure. The control valve is selectively operable between a first condition for connecting the pressure cavity to the control chamber for pushing the diaphragm against the pressure and outlet cavities, and a second condition for connecting the control chamber to ambient water pressure for allowing the diaphragm to relax, for allowing a flow of water under pressure between the pressure cavity and the outlet cavity.

In another aspect of the present invention, the control valve has a cylindrical cavity; a first magnet mounted in a fixed manner in this cylindrical cavity and a second magnet movably mounted in the cylindrical cavity. The second magnet is movable between a first location in a proximity of the first magnet and a second location away from the first magnet. The first and second magnets are mounted to attract each other.

The control valve has a passage there through to the aforesaid control chamber between the first and second magnets. The passage is selectively openable to the source of water under pressure when the second magnet is in the first location, and closed to the source of water under pressure and open to ambient water pressure when the second magnet is in the second location, connecting the control chamber to ambient water pressure.

The control valve also has a solenoid that is operable for selectively moving the second magnet between the first and second locations.

In another aspect of the present invention, a combination of a pressure cavity, an outlet cavity, a control chamber, a control valve and a segment of the diaphragm constitutes one diaphragm valve. The thruster pod has a plurality of diaphragm valves therein that are selectively operable to operate corresponding outlet ports.

In yet another aspect of the present invention, the pump plate is circular and has four diaphragm valves and outlet ports oriented radially there about.

In yet a further aspect of the present invention, there is provided a diaphragm support plate between the diaphragm and the pump plate to protect the diaphragm from excessive pump pressure.

In yet another aspect of the present invention, the source of water under pressure is obtained by a pump impeller mounted in the pump plate.

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

The drawings illustrate two preferred embodiments of underwater thruster pods. More specifically.

DESCRIPTION OF THE PREFERRED EMBODIMENTS

Figure 1:
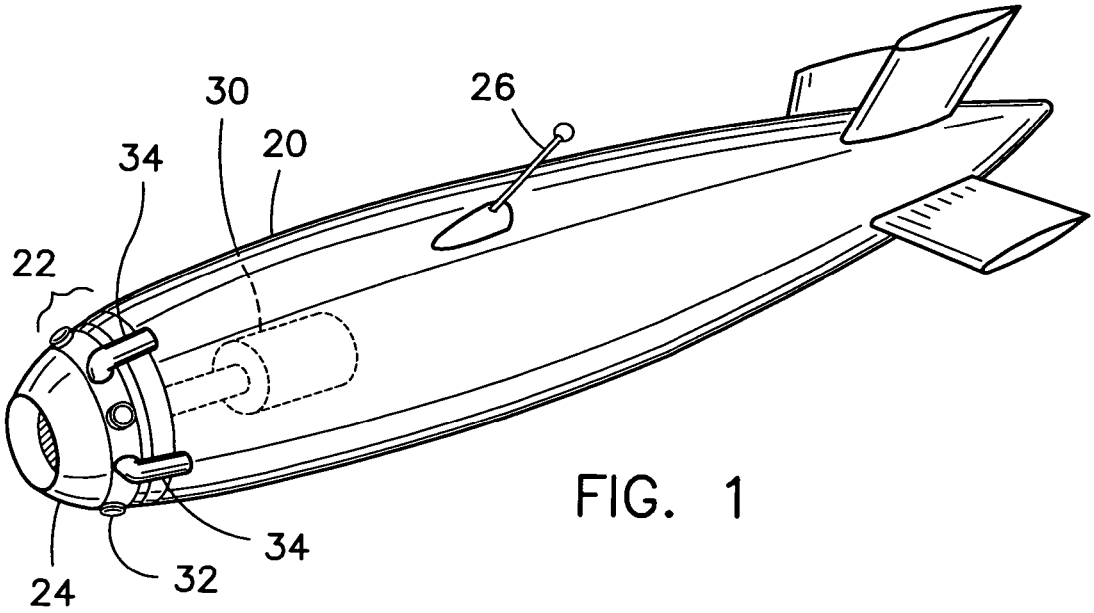
FIG. 1 illustrates a torpedo having the thruster pod according to the first preferred embodiment mounted on the front end thereof.

While this invention is susceptible of embodiment in many different forms, there is shown in the drawings and will be described in details herein two specific embodiments of the present invention, with the understanding that the present disclosure is to be considered as an example of the principles of the invention and is not intended to limit the invention to the embodiments illustrated and described.

In the drawings, the same numerals are used to illustrate and described the same elements in both embodiments where the description permits.

Referring firstly to FIG. 1, there is illustrated a torpedo 20 having the thruster pod 22 according to the first preferred embodiment mounted in its front end, and a nose cone 24 directing water to an impeller mounted inside the thruster pod 22. The thruster pod 22 may be operated in a wireless manner such that it can be used in remotely operated vehicles (ROV) of many types. This wireless system may comprise an antenna 26, which is illustrated for convenience. It will be appreciated that an antenna 26 may be used for surface application, and can be replaced by a tether line (not shown) when the thruster pod 22 is used in underwater vehicles.

The impeller (not shown) is operated by an electric motor 30 mounted in the front end of the torpedo. The electric motor 30 is illustrated in dashed lines for convenience in FIG. 1.

The thruster pod 22 has several jet ports 32 around its circumference. Some of these jet ports 32 have nozzles 34 that are curved and oriented backward for propelling the torpedo in the forward direction. The other jet ports 32 are oriented radially and can be used intermittently for steering the water craft.

Figure 2:
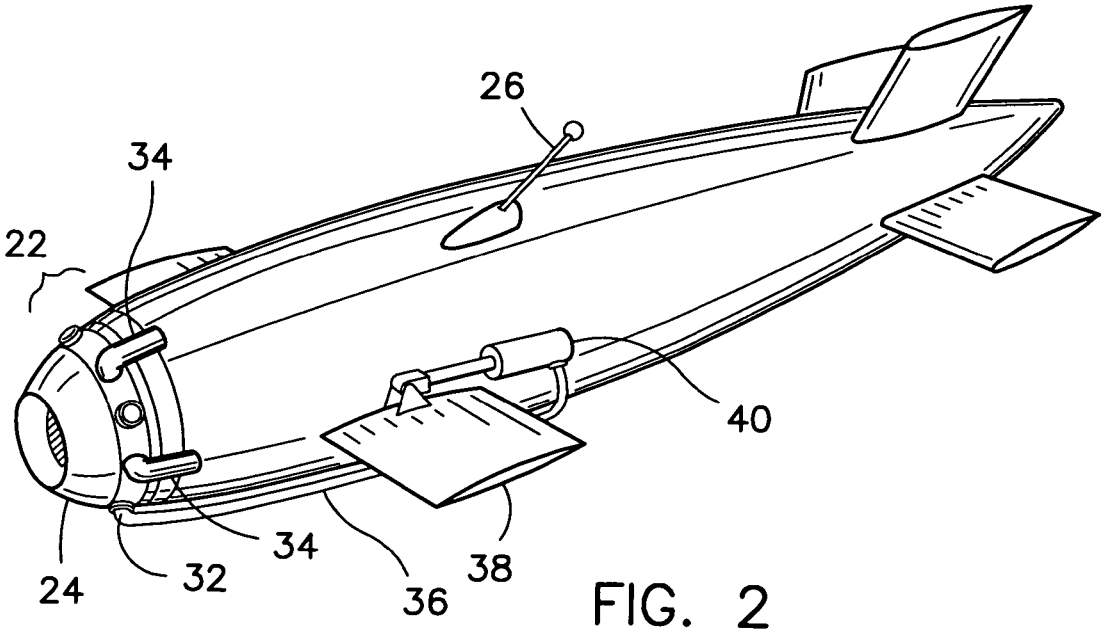
FIG. 2 illustrates another torpedo wherein the flow from one outlet nozzle in used as a source of fluid under pressure to operate a linear actuator.

Referring now to FIG. 2, it will be appreciated that one or more jet ports 32 can be used as a source of hydraulic pressure connected by piping 36 to hydraulic equipment or tooling. Such feature is explained in the illustration of a stabilizer fin 38 that is operated by an hydraulic cylinder 40.

The first preferred thruster pod 22 and its operation are illustrated in FIGS. 3-10. Broadly, the thruster pod 22 is made of a pump impeller 50 mounted at the centre of a pump plate 52; a diaphragm 54 and a valve plate 56. Preferably, a diaphragm support plate 58 is also included between the pump plate 52 and the diaphragm 54 for preventing wear, fatigue and damage to the diaphragm 54 from pump pressure.

The first preferred thruster pod 22 has eight (8) outlet ports 60, jet nozzles or jet ports. Each nozzle is connected to an outlet cavity 62 in the pump plate 52. Each outlet cavity 62 is bordering a pressure cavity 64, and it is separated from that pressure cavity 64 by a partition 66. The pressure cavity 64 communicates with the impeller housing 68 or a volute in which the impeller 50 rotates.

It will be appreciated that when the impeller 50 rotates, a pressure is created inside the pump housing 68 and in all the pressure cavities 64.

Figure 4:
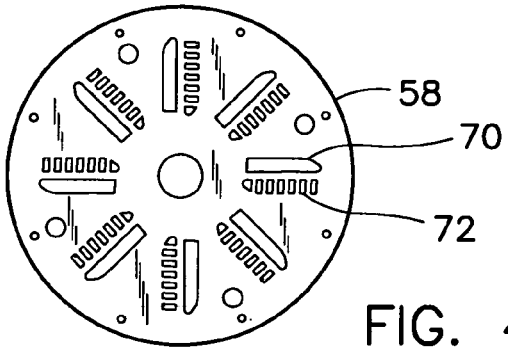
FIG. 4 is a plan view of the diaphragm support plate that is preferably mounted in the first preferred thruster pod.
Figure 5:
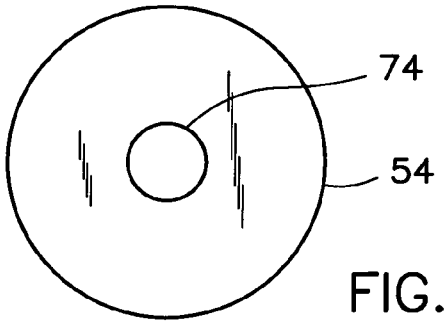
FIG. 5 is a plan view of the diaphragm mounted in the first preferred thruster pod.

Referring now to FIG. 4, the diaphragm support plate 58, has side-by-side pressure opening 70 and outlet opening 72 pairs for each pressure and outlet cavity pair in the pump plate 52. The pressure opening 70 is fully open, while the outlet opening 72 has grate-like openings for preventing damage to the diaphragm 54 from pump pressure.

The pump plate 52, the diaphragm support plate 58 and the valve plate 56 can be made of metal or plastic material in a casting or a CNC machining process.

The diaphragm 54 is made of thin, strong, flexible and impermeable diaphragm material. A hole 74 at the centre of the diaphragm 54 lets pressure from the pump housing 68 be transmitted to the valve plate 56, for the purpose of transmitting control pressure to the valve plate 56.

The valve plate as a central cavity 80 communicating with the hole 74 at the centre of the diaphragm 54 and with the pump housing 68. Eight radial slots 82 join the central cavity 80 to eight control valves 84 respectively. Each control valve 84 is connected by conduits 86 to a respective control chamber 88. It will be appreciated that the valve plate 56 has a radial slot 82; a control valve 84; conduits 86 and a control chamber 88 for each pressure and outlet cavity pair 62, 64 in the pump plate 52, and for each diaphragm valve in the thruster pod 22.

Figure 3:
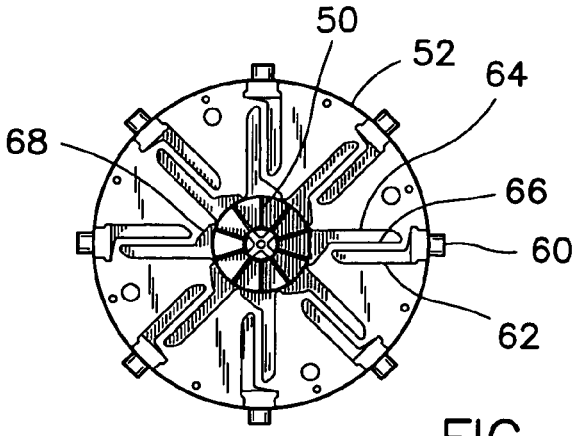
FIG. 3 is a plan view of the pump and pump plate in the first preferred thruster pod.
Figure 6:
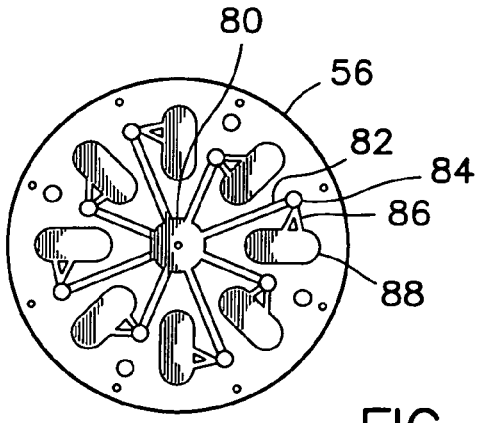
FIG. 6 is a plan view of the valve plate mounted in the first preferred thruster pod.
Figure 7:
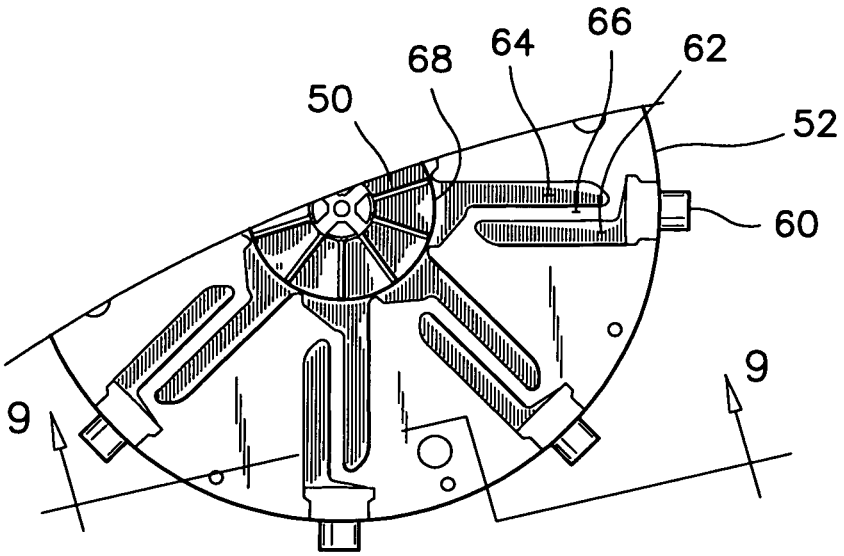
FIG. 7 is a partial enlarged plan view of the pump and pump plate illustrated in FIG. 3.
Figure 8:
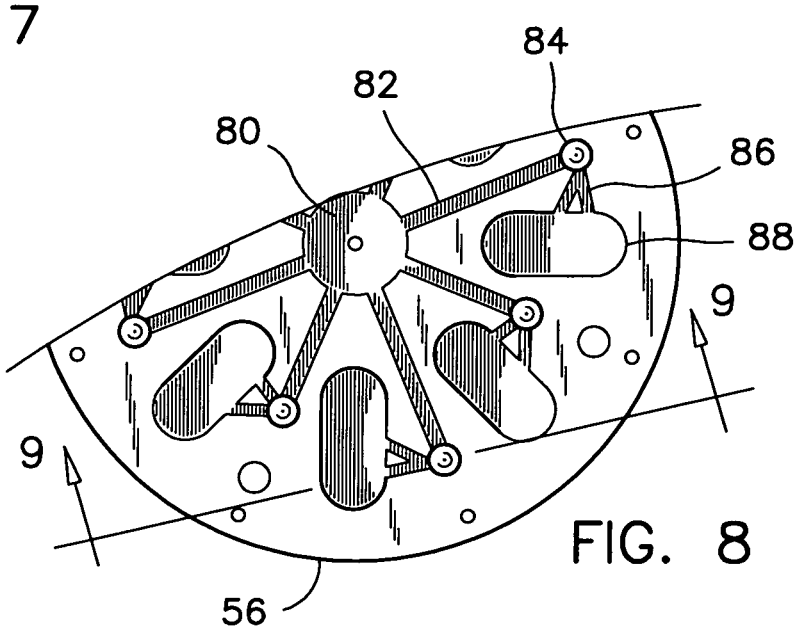
FIG. 8 is a partial enlarged plan view of the valve plate illustrated in FIG. 6.

In use, the pump plate 52; the diaphragm support plate 58, the diaphragm 54 and the valve plate 56 are stacked over each other in the order in which they are illustrated, and fastened to each other in any suitable way. The views illustrated in FIGS. 3 and 6 are the faces of each plate 52, 56. In use these faces are mounted against each other.

Although a pump impeller 50 has been illustrated in FIG. 3, it will be appreciated that all that is required in the pump plate 52 is a source of water under pressure. Therefore, a pump may be located somewhere else than illustrated and connected to the pump housing 68 by piping for example.

Referring now more specifically to FIGS. 7 to 10, the operation of the first preferred thruster pod 22 will be explained.

Figure 9:
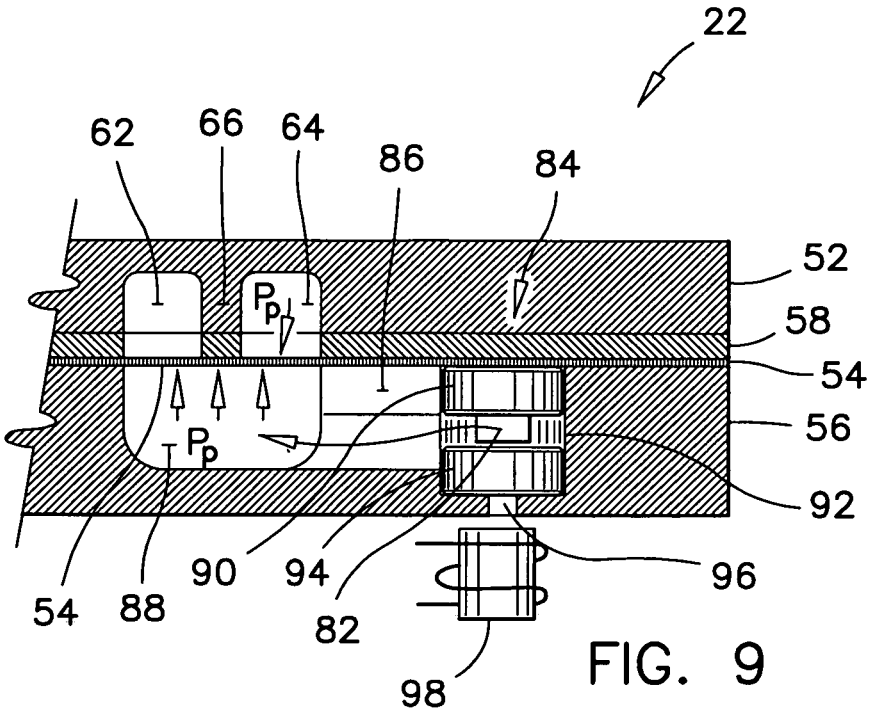
FIG. 9 is a cross-section view of the pump and pump plate as viewed substantially along lines 9-9 in FIGS. 7 and 8, showing one of the diaphragm valves in a closed mode.
Figure 10:
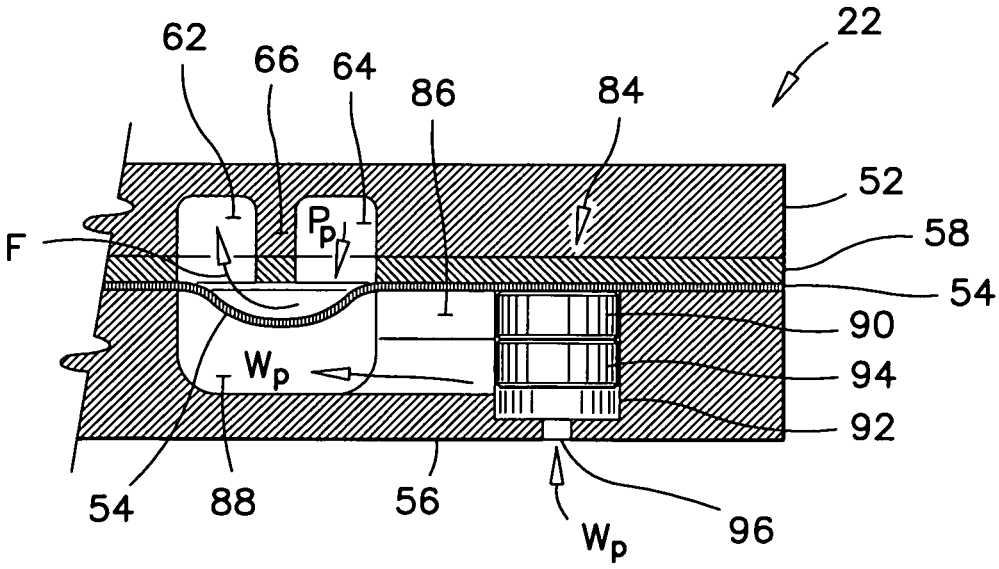
FIG. 10 is another cross-section view of the pump and pump plate as viewed substantially along lines 9-9 in FIGS. 7 and 8, showing one of the diaphragm valves in an open mode.

Firstly, each control valve 84 contains a fixed magnet 90 that is mounted stationary to the top portion of a cylindrical cavity 92 as seen in FIGS. 9 and 10. A second magnet 94, referred to as a movable magnet is movably mounted in the cylindrical cavity 92 under the fixed magnet 90. The slot 82 communicates with the cylindrical cavity 92 in a region immediately under the fixed magnet 90, when both magnets 90, 94 are separated from each other, as may be appreciated from the illustration in FIG. 9. When both magnets 90, 94 are separated, the pressure from the pump housing 68 is transmitted through the slot 82; into the cylindrical cavity 92 and into the control chamber 88 via the conduit 86.

A drain hole 96 in the bottom of the cylindrical cavity 92 allows ambient pressure to enter the valve cavity 92, and into the control chamber 88 via the conduit 86 as it may be understood when looking at FIG. 10.

The magnets 90, 94 are mounted to attract each other. Therefore, when there is no outside influence, both magnets 90, 94 are held against each other as shown in FIG. 10, such that the movable magnet 94 closes the passage from the slot 82 to the control chamber 88. The pressure in the control chamber 88 is thereby reduced to the ambient water pressure Wp through the drain hole 96. The pump pressure Pp in the pressure cavity 64 forces the diaphragm 54 downward to create a passage under the partition 66 and to open the pressure cavity 64 to the outlet cavity 62 and to a corresponding outlet port 60. A flow of water under pressure is thereby obtained at the outlet port 60.

When the movable magnet 94 is separated from the fixed magnet 90, by force of a solenoid 98 for example, the control chamber 88 is pressurized to pump pressure Pp from the pressure cavity 64 through the slot 82. As a result, the diaphragm 54 is pushed upward to block the openings 70 and 72 and to shut off the flow to the corresponding outlet port 60.

It will be appreciated that the pump pressure Pp always included ambient water pressure Wp when the thruster pod 22 is used underwater. Therefore, the diaphragm valves are operated on a differential pressure which remains the same whether the thruster pod 22 is operated in surface water or in deep water. External pressure does not affect the operation of the thruster pod 22.

It will also be appreciated that the movable magnet 94 can be displaced without touching it such that sealing of an actuator from deep sea pressure is not required. The positioning of the movable magnet 94 may be effected by a solenoid 98 as shown, or by a stronger magnet (not shown) that is moved in and out of a proximity of the control valve 84 by a servo motor for example.

Referring now to FIGS. 11-18, the thruster pod 122 according to the second preferred embodiment will be described. The elements in this second embodiment that have same functions as their equivalents in the first embodiment are labelled with numbers differing from their equivalent elements by 100, to facilitate the understanding of the principle of the invention.

The second preferred thruster pod 122 and its operation are illustrated in FIGS. 11-18. The thruster pod 122 in the second preferred embodiment is made of a pump impeller 150 mounted at the centre of a pump plate 152; a diaphragm 154 and a valve plate 156. A diaphragm support plate 158 is also preferably included between the pump plate 152 and the diaphragm 154, for preventing wear, fatigue and damage to the diaphragm 154 from pump pressure.

The second preferred thruster pod 122 has four (4) outlet ports 160 or jet nozzles. Each nozzle 160 is connected to an outlet cavity 162. Each outlet cavity 162 is bordering a pressure cavity 164, and it is separated from that pressure cavity 164 by a partition 166. The pressure cavity 164 communicates with the impeller housing 168 or a volute in which the impeller 150 rotates.

It will be appreciated that when the impeller 150 rotates, a pressure is created inside the pump volute 168 and in all the pressure cavities 164.

Figure 12:
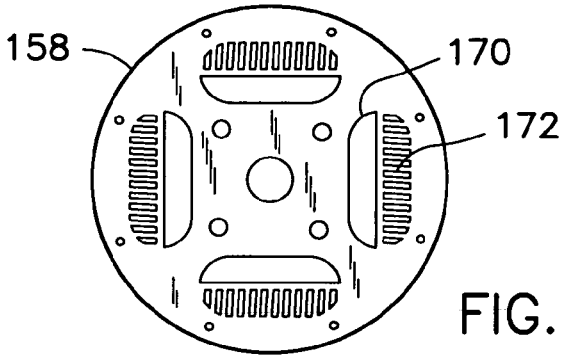
FIG. 12 is a plan view of the diaphragm support plate that is preferably mounted in the second preferred thruster pod.
Figure 13:
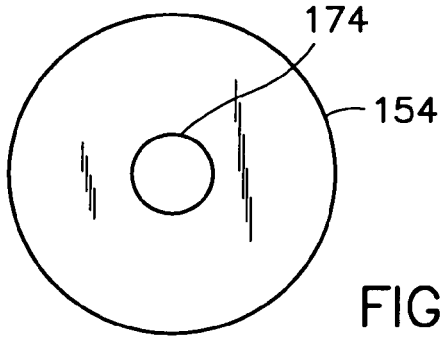
FIG. 13 is a plan view of the diaphragm mounted in the second preferred thruster pod.

Referring now to FIG. 12, the diaphragm support plate 158, has side-by-side pressure opening 170 and outlet opening 172 pairs corresponding to the location of each pressure and outlet cavity pair 162, 164 in the pump plate 152. The pressure opening 170 is fully open while the outlet opening 172 has a grate-like openings for preventing damage to the diaphragm 154 from pump pressure.

The pump plate 152, the diaphragm support plate 158 and the valve plate 156 are made in a same way as explained in the thruster of the first preferred embodiment.

The diaphragm 154 is made of thin, strong, flexible and impermeable diaphragm material. A hole 174 at the centre of the diaphragm 154 lets pressure from the pump housing 168 be transmitted to the valve plate 156, for the purpose of transmitting control pressure to the valve plate 156.

The valve plate as a central cavity 180 communicating with the hole 174 at the centre of the diaphragm 154 and with the pump housing 168. Four radial slots 182 join the central cavity 180 to four control valves 200 respectively. Each control valve 200 is connected by a conduit 186 to a respective pressure control chamber 188. It will be appreciated that the valve plate 156 has a radial slot 182; a valve 200; conduits 186 and a pressure control chamber 188 for each pressure and outlet pair 162, 164 in the pump plate 152 and for each diaphragm valve in the thruster pod 122.

Figure 11:
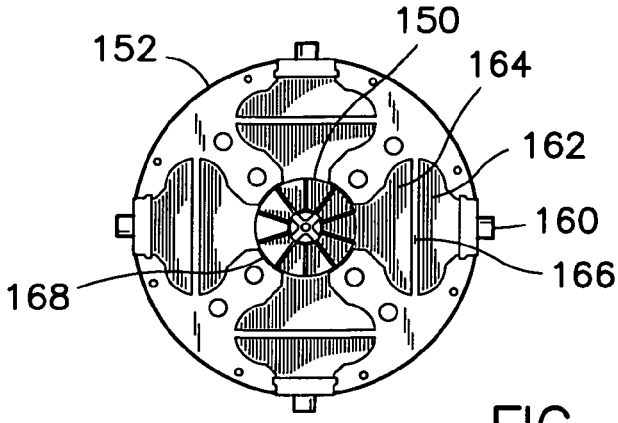
FIG. 11 is a plan view of the pump and pump plate in the second preferred thruster pod.
Figure 14:
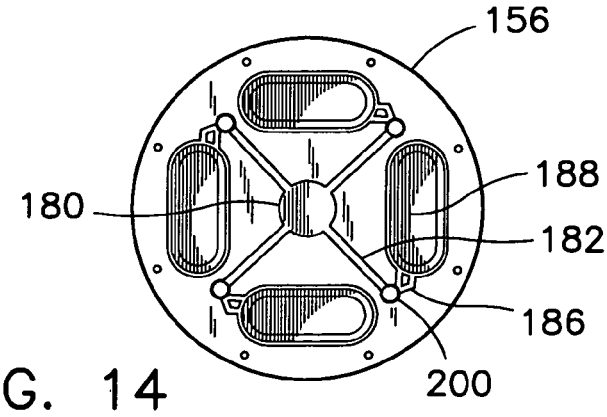
FIG. 14 is a plan view of the valve plate mounted in the second preferred thruster pod.
Figure 15:
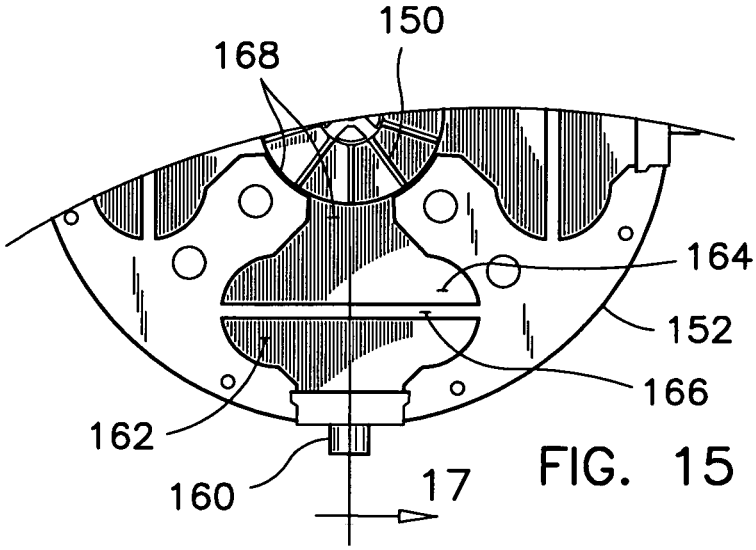
FIG. 15 is a partial enlarged plan view of the pump and pump plate illustrated in FIG. 11.
Figure 16:
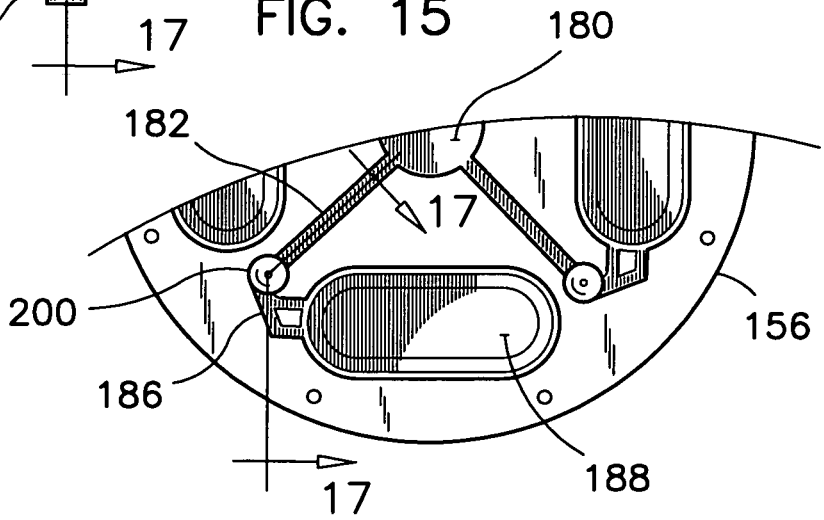
FIG. 16 is a partial enlarged plan view of the valve plate illustrated in FIG. 14.

In use, the pump plate 152; the diaphragm support plate 158, the diaphragm 154 and the valve plate 156 are stacked over each other in the order in which they are illustrated, and fastened to each other in any suitable way. The views illustrated in FIGS. 11 and 14 are the faces of each plate 152, 156. In use these faces are mounted against each other.

Referring now more specifically to FIGS. 15 to 18, the operation of the second preferred thruster pod 122 will be explained.

Figure 17:
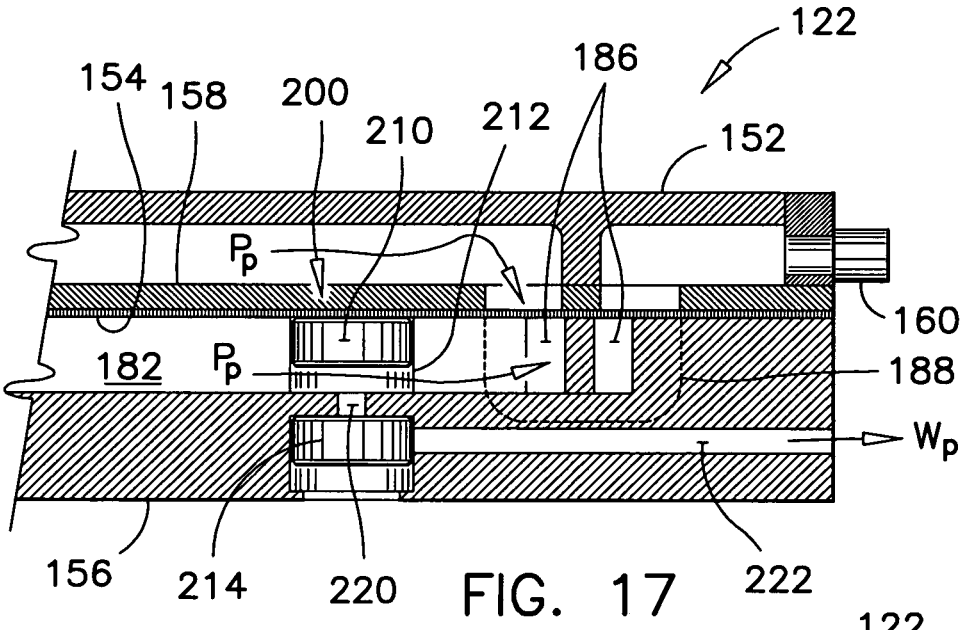
FIG. 17 is a cross-section view of the pump and pump plate as viewed substantially along lines 17-17 in FIGS. 15 and 16, showing one of the diaphragm valves in a closed mode.
Figure 18:
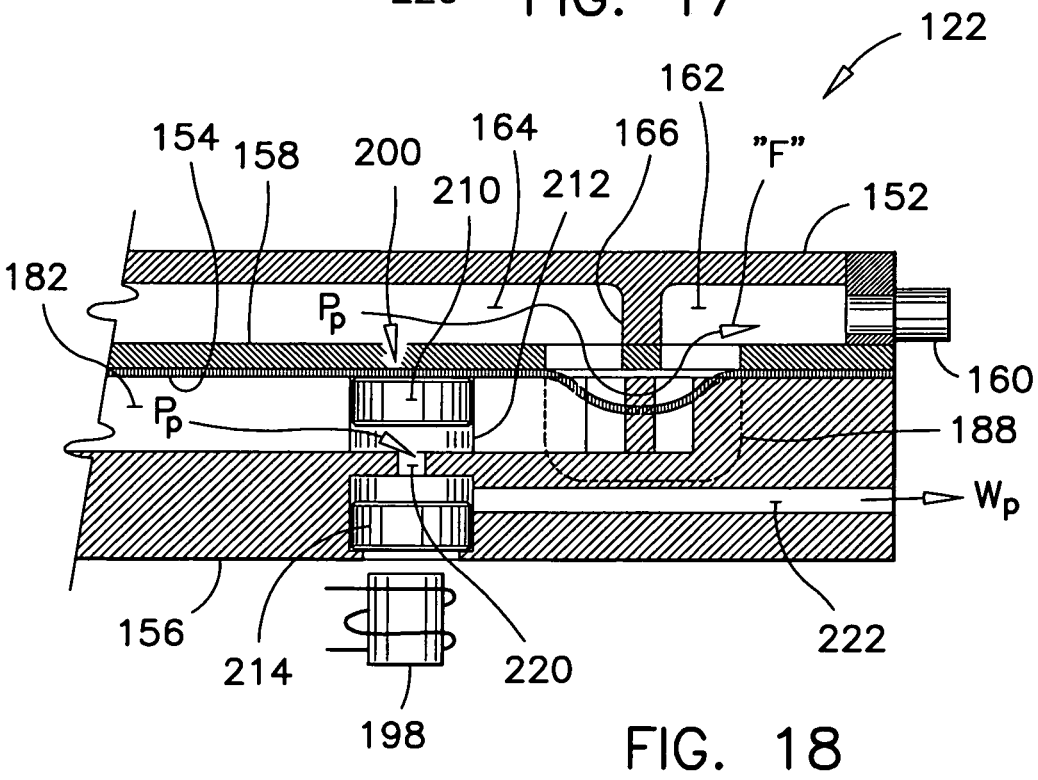
FIG. 18 is another cross-section view of the pump and pump plate as viewed substantially along lines 17-17 in FIGS. 15 and 16, showing one of the diaphragm valves in an open mode.

Firstly, each control valve 200 contains a fixed magnet 210 that is mounted in a stationary manner to the top portion of a cylindrical cavity 212, as seen in FIGS. 17 and 18. A second magnet 214, referred to as a movable magnet, is movably mounted in the cylindrical cavity 212 under the fixed magnet 210. The slot 182 communicates with the cylindrical cavity 212 in a region immediately under the fixed magnet 210, and with the pressure control chamber 188, through the slot 186 as may be appreciated from the illustrations in FIGS. 17, and 18.

When both magnets 210, 214 are separated, the pressure from the pump housing 168 is transmitted from the cylindrical cavity 212 to the control chamber 188 via the conduit 186.

A calibrated orifice 220 between the fixed and the movable magnets 210, 214 communicates with a drain channel 222 when the movable magnet 214 is moved away from the fixed magnet 210. When the movable magnet is pulled away from the fixed magnet 210, by the force of a solenoid 198 for example, the pump pressure in the conduit 182 is released to this drain channel 222, thereby reducing the pressure inside the control chamber 188.

As a result of this pressure reduction in the control chamber 188, the diaphragm 154 is forced to open to allow a flow F under the partition 166 from the pressure cavity 164 to the outlet cavity 162 and the outlet port 160 as indicated in FIG. 18.

It will be appreciated that the orifice 220 is calibrated to release only sufficient pressure to allow the operation of the control valve 200, without adversely affecting the operation or the performance of other diaphragm valves in the thruster pod 122.

When the solenoid 198 is de-energized, the movable magnet 214 is attracted to the fixed magnet 210 thereby closing the drain hole 220 and re-establishing a pump pressure Pp in the control chamber 188.

The control valve 200 also works on a differential pressure between the pump pressure Pp and the ambient or water pressure Wp. It will be appreciated that this pressure differential remains the same whether the thruster pod 122 is operated in surface water or in deep water. External pressure does not affect the operation of the thruster pod 122.

As to other manner of usage and operation of the present invention, the same should be apparent from the above description and accompanying drawings.

What is claimed is:

1. A thruster pod comprising a housing; a diaphragm; a control chamber on one side of said diaphragm; a source of water under pressure; an outlet port for projecting a flow of water under pressure outside said housing and a control valve being operable for changing a pressure in said control chamber, said diaphragm being operable for movement between a first position and a second position upon a change in pressure in said control chamber, said first position closing said outlet port, and said second position opening said outlet port to said source of water under pressure;

said control valve having a cylindrical cavity; a first magnet mounted in a fixed manner in said cylindrical cavity and a second magnet movably mounted in said cylindrical cavity; said second magnet being movable between a first location in a proximity of said first magnet and a second location away from said first magnet; said first and second magnets being mounted to attract each other;

said control valve also having a slot therein between said first and second magnets;

said slot communicating with said source of water under pressure said chamber; said slot and said control chamber being selectively openable to said source of water under pressure when said second magnet is in said second location, and closed to said source of water under pressure and open to ambient water pressure when said second magnet is in said first location; and said control valve further having a solenoid mounted therein and said solenoid being operable for selectively moving said second magnet between said first and second locations.

2. A thruster pod comprising a housing; a diaphragm; a control chamber on one side of said diaphragm; a source of water under pressure; an outlet port for projecting a flow of water under pressure outside said housing and a control valve being operable for changing a pressure in said control chamber;

said diaphragm being operable for movement between a first position and a second position upon a change in pressure in said, control chamber; said first position closing said outlet port, and said second position opening said outlet port to said source of water under pressure;

said control valve having a cylindrical cavity; a first magnet mounted in a fixed manner in said cylindrical cavity and a second magnet movably mounted in said cylindrical cavity; said second magnet being movable between a first location in a proximity of said first magnet and a second location away from said first magnet; said first and second magnets being mounted to attract each other;

said control valve also having a slot therein between said first and second magnets; said slot communicating with said source of water under pressure and said control chamber; and a drain hole communicating with said control chamber and ambient water pressure;

said slot and said drain hole being selectively separately openable upon a movement of said second magnet between said first and second locations, for changing a pressure in said control chamber and for operating said diaphragm; and said control valve further having a solenoid mounted therein and said solenoid being operable for selectively moving said second magnet between said first and second locations.

3. A thruster pod comprising a housing; a diaphragm; a control chamber on one side of said diaphragm; a source of water under pressure; an outlet port for projecting a flow of water under pressure outside said housing and a control valve being operable for changing a pressure in said control chamber;

said diaphragm being operable for movement between a first position and a second position upon a change in pressure in said control chamber; said first position closing said outlet port, and said second position opening said outlet port to said source of water under pressure;

said control valve having a cylindrical cavity; a first magnet mounted in a fixed manner in said cylindrical cavity and a second magnet movably mounted in said cylindrical cavity; said second magnet being movable between a first location in a proximity of said first magnet and a second location away from said first magnet; said first and second magnets being mounted to attract each other;

said control valve also having a slot therein between said first and second magnets; said slot communicating with said source of water under pressure and said control chamber; and a calibrated orifice communicating with said control chamber and ambient water pressure;

said calibrated orifice being selectively openable upon a movement of said second magnet between said first and second locations, for changing a pressure in said control chamber and for operating said diaphragm; and said control valve further having a solenoid mounted therein and said solenoid being operable for selectively moving said second magnet between said first and second locations.

* * * * *